US011047134B2

(12) United States Patent
Steffes et al.

(10) Patent No.: US 11,047,134 B2
(45) Date of Patent: Jun. 29, 2021

(54) MANUFACTURED BUILDING PANEL

(71) Applicant: CERTAINTEED CORPORATION, Malvern, PA (US)

(72) Inventors: Stephen W. Steffes, McPherson, KS (US); David J. Stucky, Grass Lake, MI (US); Andrew Clyde Brandt, Pottstown, PA (US); Robert D. Shaw, Parma, MI (US); Nikki J. Whitney, Lansing, MI (US)

(73) Assignee: CERTAINTEED LLC, Malvern, PA (US)

( * ) Notice: Subject to any disclaimer, the term of this patent is extended or adjusted under 35 U.S.C. 154(b) by 0 days.

(21) Appl. No.: 16/865,989

(22) Filed: May 4, 2020

(65) Prior Publication Data

US 2020/0262104 A1 Aug. 20, 2020

Related U.S. Application Data

(63) Continuation of application No. 15/839,154, filed on Dec. 12, 2017, now Pat. No. 10,682,787, which is a (Continued)

(51) Int. Cl.
*E04F 13/08* (2006.01)
*B28B 23/00* (2006.01)

(52) U.S. Cl.
CPC ..... *E04F 13/0801* (2013.01); *E04F 13/0864* (2013.01); *B28B 23/005* (2013.01); *B28B 23/0056* (2013.01); *E04F 13/0873* (2013.01)

(58) Field of Classification Search
CPC ..... B28B 23/005; B28B 23/0056; E04F 13/0835; E04F 13/0864; E04F 13/0851; E04F 13/0803; E04F 13/0801

(Continued)

(56) References Cited

U.S. PATENT DOCUMENTS 1,821,487 A * 9/1931 Thompson ..... B29C 43/18 188/251 A
2,103,569 A * 12/1937 Wallace ..... E04F 13/0803 52/714

(Continued)

FOREIGN PATENT DOCUMENTS

CA 2306916 * 5/1999 ..... E04F 13/0803
CA 155209 S 1/2015

(Continued)

OTHER PUBLICATIONS

"U.S. Appl. No. 61/717,905, filed Oct. 24, 2012, Inventors: Stephen W. Steffes et al".

(Continued)

*Primary Examiner* — Michael Safavi
(74) *Attorney, Agent, or Firm* — Abel Schillinger, LLP; Thomas H. Osborn

(57) ABSTRACT

A method of fabricating panels includes providing an insert having an interior portion with a top portion and a positioning stop opposite the top portion, and an exterior portion including a fastener hem. Further, the method includes placing the insert in a mold such that only the fastener hem and the positioning stop contact the mold and centering the insert in the mold with the top portion and the positioning stop. The method also includes filling the mold with a casting material such that the interior portion is submerged in the casting material including the top portion, but some of the positioning stop is not submerged in the casting material, curing the casting material to form a panel on the insert, and removing the panel form the mold.

18 Claims, 5 Drawing Sheets

Related U.S. Application Data continuation of application No. 14/861,868, filed on Sep. 22, 2015, now Pat. No. 9,869,098, which is a continuation of application No. 14/060,318, filed on Oct. 22, 2013, now Pat. No. 9,169,652.

(60) Provisional application No. 61/717,905, filed on Oct. 24, 2012.

(58) Field of Classification Search
USPC ..... 264/259, 271.1, 273, 274, 275, 279; 249/83, 91, 93; 52/509, 510, 511, 512, 52/235
See application file for complete search history.

(56) References Cited

U.S. PATENT DOCUMENTS 2,329,610 A * 9/1943 Harman ..... E04C 2/26 52/388
2,635,450 A * 4/1953 Orzel ..... B28B 7/18 52/582.1
2,770,864 A * 11/1956 Weese ..... B28B 1/503 264/42
2,920,475 A * 1/1960 Graham ..... B28B 23/0006 52/432
3,272,904 A * 9/1966 Millard ..... B29C 33/0033 264/275
3,308,725 A * 3/1967 Nagin ..... E01D 19/083 404/20
3,312,030 A * 4/1967 Gillespie ..... E04F 13/141 52/796.1
3,336,709 A 8/1967 Berney et al.
3,353,220 A * 11/1967 Lenoble ..... B28B 7/0038 425/123
3,421,281 A * 1/1969 Harris ..... E04F 13/0803 52/483.1
3,431,012 A * 3/1969 Eriksson ..... B28B 23/005 294/89
3,596,971 A * 8/1971 Courtois ..... B28B 23/005 294/89
3,705,469 A * 12/1972 Eriksson ..... B28B 23/005 52/125.4
3,968,610 A 7/1976 Medow
4,000,591 A * 1/1977 Courtois ..... B28B 23/005 52/689
4,065,540 A * 12/1977 Okami ..... B28B 19/00 264/278
4,145,024 A * 3/1979 Ward ..... E04C 5/16 249/218
4,284,447 A * 8/1981 Dickens ..... B29C 33/16 156/299
4,531,338 A 7/1985 Donatt
4,553,366 A * 11/1985 Guerin ..... E04F 13/0803 52/506.08
4,605,583 A * 8/1986 Frahme ..... F27D 1/0013 428/126
4,607,471 A 8/1986 Olsen
4,737,333 A * 4/1988 Matthynssens ..... B28B 23/00 238/88
4,834,929 A * 5/1989 Dehoff ..... B29C 33/3857 249/115
D309,027 S 7/1990 Noone et al.
5,112,393 A 5/1992 Engel et al.
5,314,530 A 5/1994 Wierer et al.
5,642,597 A 7/1997 Hendrickson
5,715,637 A 2/1998 Lesterman et al.
5,819,486 A * 10/1998 Goodings ..... E04F 13/0816 52/235
6,044,609 A 4/2000 Kim
6,178,703 B1 1/2001 Noone et al.
6,230,409 B1 * 5/2001 Billings ..... B28B 1/16 264/251
6,240,691 B1 6/2001 Holzkaemper et al.
6,253,515 B1 * 7/2001 Kuelker ..... B28B 1/0873 52/384
6,287,046 B1 9/2001 Neuhofer, Jr.
6,713,548 B1 3/2004 Zhang et al.
6,868,643 B1 3/2005 Williams
6,883,277 B2 4/2005 Wiechecki et al.
RE39,091 E * 5/2006 Kuelker ..... 52/384
7,415,803 B2 * 8/2008 Bronner ..... F16B 37/16 52/377
7,491,426 B1 2/2009 Rooshenas
7,615,254 B2 11/2009 Smith
7,662,221 B2 2/2010 Fay
7,670,415 B1 3/2010 Rosenberg et al.
7,735,429 B2 6/2010 Meissen
7,793,474 B2 9/2010 Tyler et al.
7,825,171 B2 11/2010 Copeland
7,841,147 B2 11/2010 Moran
D643,133 S 8/2011 Steffes et al.
7,997,039 B2 8/2011 Wolf et al.
7,998,530 B2 8/2011 Batdorf
8,042,309 B2 10/2011 Wolf et al.
8,065,850 B1 11/2011 Moran
8,112,966 B2 2/2012 Bowe et al.
8,202,919 B2 6/2012 Copeland
D665,512 S 8/2012 Yoder et al.
D670,009 S 10/2012 Buoni
D674,508 S 1/2013 Yoder et al.
D674,920 S 1/2013 Buoni
8,387,323 B2 3/2013 Mickelson
8,513,328 B2 8/2013 Dorman
8,524,822 B2 9/2013 Wiercinski
8,557,909 B2 10/2013 Stuart et al.
8,580,866 B2 11/2013 Nones et al.
8,707,649 B2 4/2014 Wilkie et al.
8,748,528 B2 6/2014 Cao et al.
8,782,988 B2 7/2014 Wolf et al.
8,806,826 B2 8/2014 Mann
8,808,599 B2 * 8/2014 Lee ..... F25C 5/22 264/248
D713,552 S 9/2014 Steffes et al.
D713,974 S 9/2014 Steffes et al.
8,997,423 B2 4/2015 Mann
9,027,302 B2 5/2015 Buoni et al.
D742,034 S 10/2015 Steffes et al.
D742,035 S 10/2015 Steffes et al.
9,169,652 B2 10/2015 Steffes et al.
9,260,871 B2 2/2016 Shaw
9,677,283 B2 * 6/2017 Attebery, II ..... E04F 13/24
D809,671 S 2/2018 Steffes et al.
10,329,775 B2 6/2019 Wolf et al.
D857,922 S 8/2019 Steffes et al.
2003/0066259 A1 * 4/2003 Sudweeks ..... E04B 2/02 52/506.05
2004/0050003 A1 3/2004 Passeno
2004/0065035 A1 4/2004 De Vlam
2005/0102946 A1 5/2005 Stucky et al.
2005/0247021 A1 11/2005 Schauffele
2006/0075712 A1 4/2006 Gilbert et al.
2007/0119109 A1 * 5/2007 Kuelker ..... B28B 23/005 52/364
2007/0137127 A1 6/2007 Lincoln et al.
2007/0294976 A1 12/2007 Fay
2008/0083186 A1 4/2008 Gaudreau
2008/0155921 A1 7/2008 Wolf et al.
2008/0155922 A1 7/2008 Wolf et al.
2009/0084058 A1 4/2009 Cahill et al.
2009/0193742 A1 * 8/2009 Wolf ..... E04F 13/147 52/311.1
2009/0235596 A1 9/2009 Tyler et al.
2009/0239413 A1 9/2009 Milette
2009/0247007 A1 10/2009 Milette
2009/0249718 A1 10/2009 Tyler et al.
2011/0130062 A1 6/2011 Squires
2011/0175255 A1 * 7/2011 Wernette ..... B28B 7/007 264/271.1
2011/0175256 A1 7/2011 Wernette et al.
2011/0203212 A1 * 8/2011 Matys ..... B28B 23/005 52/562

(56) References Cited

U.S. PATENT DOCUMENTS

| | | | | |
|---|---|---|---|---|
| 2011/0203218 | A1 | 8/2011 | Solov et al. | |
| 2011/0239578 | A1* | 10/2011 | Wolf | E04F 13/147 52/588.1 |
| 2012/0039977 | A1 | 2/2012 | Dracopoulos et al. | |
| 2012/0186170 | A1 | 7/2012 | Macdonald et al. | |
| 2012/0272598 | A1 | 11/2012 | Wilkie et al. | |
| 2012/0328823 | A1 | 12/2012 | Monteer | |
| 2013/0082416 | A1* | 4/2013 | Wakeman | B29C 33/14 264/259 |
| 2013/0196070 | A1 | 8/2013 | LeFevre et al. | |
| 2013/0255177 | A1* | 10/2013 | VonDross | E04C 1/40 52/598 |
| 2013/0326967 | A1* | 12/2013 | Kim | B66C 1/666 52/125.4 |
| 2014/0041331 | A1 | 2/2014 | Buoni et al. | |
| 2014/0109504 | A1 | 4/2014 | Steffes et al. | |
| 2014/0182225 | A1 | 7/2014 | Wilkie et al. | |
| 2014/0196396 | A1 | 7/2014 | Watts et al. | |
| 2015/0021822 | A1* | 1/2015 | Wolf | E04F 13/147 264/279 |
| 2015/0191911 | A1 | 7/2015 | Mann | |
| 2015/0218829 | A1 | 8/2015 | Curtis | |
| 2015/0233371 | A1* | 8/2015 | Harvey | F04B 53/143 277/340 |
| 2016/0010342 | A1 | 1/2016 | Steffes et al. | |
| 2016/0040437 | A1 | 2/2016 | Wolf et al. | |
| 2018/0100313 | A1 | 4/2018 | Steffes et al. | |

FOREIGN PATENT DOCUMENTS

| | | | | | |
|---|---|---|---|---|---|
| CA | 155210 | S | | 2/2015 | |
| DE | 747877 | | * | 10/1944 | E04F 13/0803 |
| DE | 1937125 | A1 | * | 1/1971 | E04F 13/0835 |
| DE | 2320020 | A1 | * | 7/1974 | F16B 15/0015 |
| DE | 2540666 | A1 | * | 3/1977 | E04F 13/141 |
| DE | 202014004005 | | * | 8/2015 | E04F 13/083 |
| EP | 0077608 | | * | 4/1983 | F27D 1/144 |
| EP | 1164227 | A1 | * | 12/2001 | E04B 1/41 |
| EP | 2010616 | B1 | | 1/2009 | |
| EP | 3536873 | A1 | * | 9/2019 | E04F 13/0864 |
| FR | 963869 | | * | 7/1950 | E04F 13/0835 |
| FR | 2207510 | | * | 6/1974 | E04F 19/0468 |
| JP | 57077522 | A | * | 5/1982 | |
| JP | S5777522 | A | | 5/1982 | |
| JP | 04323006 | A | * | 11/1992 | |
| JP | H04323006 | A | | 11/1992 | |
| JP | H0673327 | A | | 3/1994 | |
| WO | WO-02097209 | | * | 12/2002 | E04F 13/0835 |
| WO | 2006009762 | A1 | | 1/2006 | |
| WO | 2011106095 | A1 | | 9/2011 | |
| WO | 2014055578 | A1 | | 4/2014 | |
| WO | 2014143780 | A1 | | 9/2014 | |

OTHER PUBLICATIONS

Design U.S. Appl. No. 29/550,927, filed Jan. 8, 2016, Inventors Stephen W. Steffes et al.

* cited by examiner

MANUFACTURED BUILDING PANEL

CROSS-REFERENCE TO RELATED APPLICATION(S)

This application is a continuation of and claims priority to the prior filed and co-pending U.S. patent application Ser. No. 15/839,154, filed on Dec. 12, 2017, by Stephen W. Steffes et al., entitled "Method and Apparatus for Fabricating A Building Panel," which is a continuation of and claims priority to U.S. patent application Ser. No. 14/861,868, filed on Sep. 22, 2015, by Stephen W. Steffes et al., entitled "System, Method and Apparatus for Manufactured Building Panel," now U.S. Pat. No. 9,869,098, which is a continuation of and claims priority to U.S. patent application Ser. No. 14/060,318, filed on Oct. 22, 2013, by Stephen W. Steffes et al., entitled "System, Method and Apparatus for Manufactured Building Panel," now U.S. Pat. No. 9,169,652, which claims priority under 35 U.S.C. § 119(e) to U.S. Provisional Patent Application No. 61/717,905, filed on Oct. 24, 2012, by Stephen W. Steffes et al., entitled "System, Method and Apparatus for Manufactured Building Panel," the disclosures of which are assigned to the current assignee hereof and incorporated herein by reference in their entireties for all purposes.

BACKGROUND OF THE INVENTION

Field of the Disclosure

The present invention relates in general to the building facades and, in particular, to a system, method and apparatus for manufactured building panels.

Description of the Related Art

There are numerous types of manufactured cladding, plates and panels that are used to provide the outer facing or façade on a building structure. There are also many ways of installing such panels, some of which require a skilled mason to complete the installation. Skilled labor for such installations can dramatically increase the labor costs. Thus, improvements in manufactured panels continue to be of interest.

SUMMARY

Embodiments of a system, method and apparatus for a manufactured panel are disclosed. For example, an embodiment of a manufactured panel may comprise a body having a front, back, top, bottom and side walls. The side walls may extend between the front and back. An interior volume may be located between the front, back, top, bottom and side walls. An insert having an interior portion may be partially or completely embedded within the interior volume of the body. An exterior portion may extend from the interior portion to an exterior of the body. The exterior portion may comprise a plurality of stand-offs protruding from the body, such that at least some of the stand-offs are connected to each other inside the interior volume of the body. The stand-offs may be independent and detached from each other on the exterior of the body.

An embodiment of a system of panels may comprise first and second manufactured panels. Each panel may comprise a body having a front, back, top, bottom and side walls, the side walls extend between the front and back, and an interior volume located between the front, back, top, bottom and side walls. Both the top and the bottom of the body may comprise an upper landing that is contiguous with and substantially perpendicular to the front of the body. A lower landing may be contiguous and uninterrupted with the back, and a bevel extending between the upper and lower landings, such that the top and bottom are complementary in shape to each other. An insert may be located inside the body and extending from the body.

Embodiments of a method of installing panels to form a building façade may comprise providing a plurality of manufactured panels, each having a body with a front, back, top, bottom and side walls, the side walls extend between the front and back, an interior volume located between the front, back, top, bottom and side walls, and an insert located inside the body and extending from the body as a fastener hem; installing the fastener hems of a first course of manufactured panels on a mounting wall; and installing a second course of manufactured panels on the mounting wall on top of the first course of manufactured panels, such that the first and second courses of manufactured panels make substantially planar contact in substantially only two dimensions at the tops of the first course of manufactured panels and the bottoms of the second course of manufactured panels.

An embodiment of a method of fabricating panels may comprise providing an insert having an interior portion with a top portion and a positioning stop opposite the top portion, and an exterior portion including a fastener hem; placing the insert in a mold such that only the fastener hem and the positioning stop contact the mold; centering the insert in the mold with the top portion and the positioning stop; filling the mold with a liquid such that the interior portion is submerged in the liquid including the top portion, but some of the positioning stop is not submerged in the liquid; curing the liquid to form a panel on the insert; and removing the panel form the mold.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
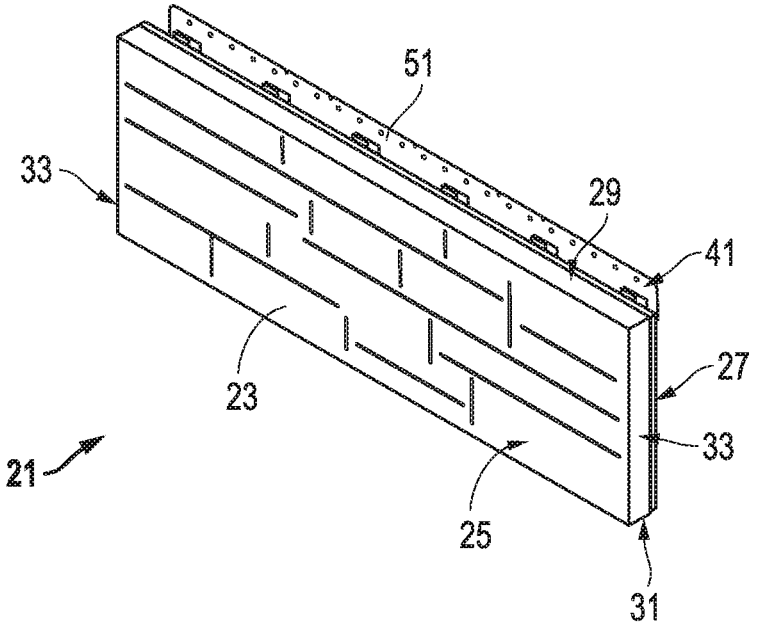
FIGS. 1 and 2 are front and rear isometric views, respectively, of an embodiment of a panel.

Embodiments of a system, method and apparatus for a manufactured panel are disclosed. For example, in the embodiment of FIGS. 1 and 2, a manufactured panel 21 may comprise a body 23 that forms an exterior building façade or an interior building façade. The body 23 may have a front 25, back 27, top 29, bottom 31 and side walls 33. The side walls 33 extend between the front 25 and back 27. The panel 21 also includes an interior volume that is located between the front, back, top, bottom and side walls. The manufactured panels 21 may be configured substantially identical to each other, and may include slight variations depending on the desired aesthetic look for the completed façade. The fronts 25 of the bodies 23 may be configured to appear as brick, stucco, wood panels, stone, tile, etc. In some versions, the body 23 may comprise a material such as concrete or concrete mixtures.

Figure 3:
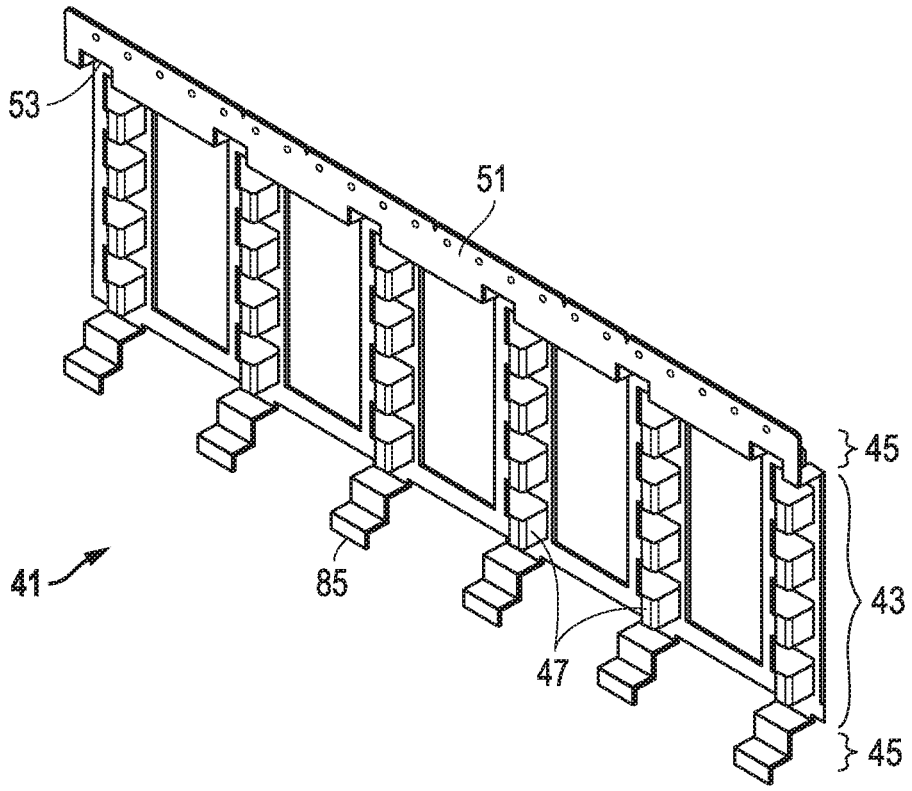
FIGS. 3 and 4 are front and rear isometric views, respectively, of an embodiment of an insert for a panel.
Figure 4:
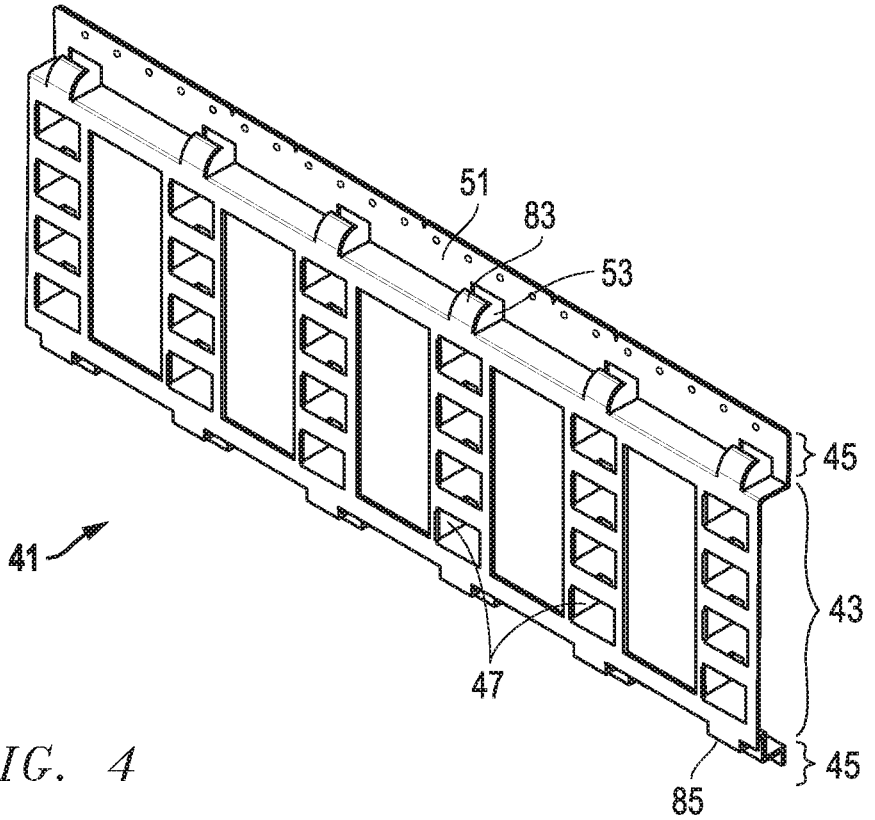

Embodiments of the panel 21 also may comprise an insert 41. Detailed views of an embodiment of insert 41 also are shown in FIGS. 3 and 4. In some versions, the same inserts 41 may be used to form panels 21, regardless of the appearance of the fronts 25 of the bodies 23. Thus, in some embodiments, the inserts 41 are universal to all types of panels 21. In some embodiments, the insert 41 may comprise a material that is non-corrosive, such as stainless steel. Other non-corrosive materials may include galvanized steel, powder-coated steel, or high strength plastic materials, for example.

Insert 41 may comprise an interior portion 43 (FIG. 9) that is partially or completely embedded within the interior volume of the body 23. An exterior portion 45 of insert 41 may extend from the interior portion 43 to an exterior of the body 23. In some embodiments, the interior portion 43 of the insert 41 extends substantially throughout the body 23 between the top 29, bottom 31 and side walls 33 of the body 23. Versions of the interior portion 43 may be substantially planar as shown and form a continuous reinforcement throughout the body 23. This design facilitates protection against crumbling if and when the body is cut, partitioned or segmented.

Figure 2:
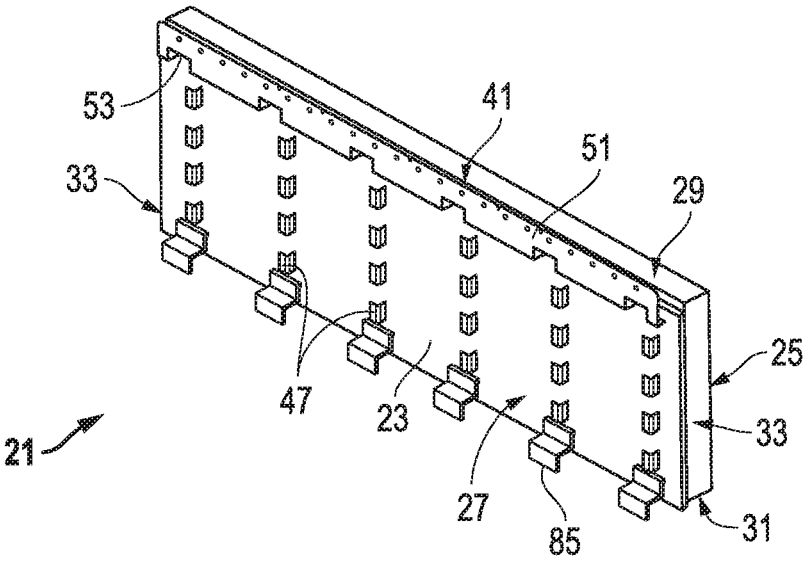

The exterior portion 45 may comprise a plurality of stand-offs 47 protruding from the body 23. At least some of the stand-offs 47 may be connected to each other inside the interior volume of the body 23 via portions of the interior portion 43 (e.g., via a frame). At least some of the stand-offs 47 may be independent and detached from each other on the exterior of the body 23, as shown. As shown in FIGS. 2, 3, and 4, one stand-off 47 can be located near the top 29 of the body 23, another stand-off 47 can be located near the bottom 31 of the body 23, and the insert 41 can connect the stand-offs 47.

Figure 5:
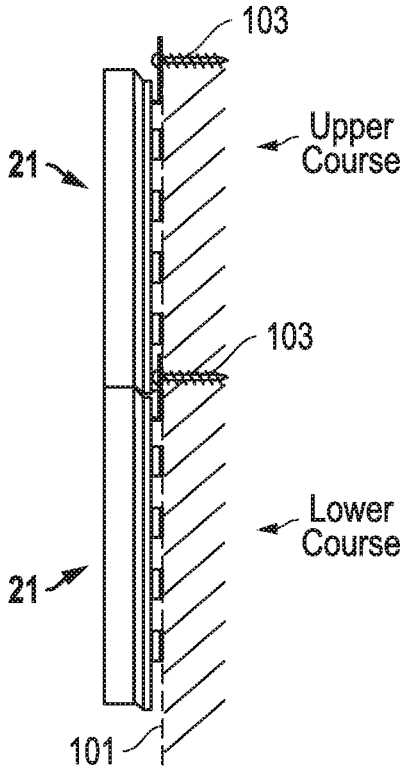
FIG. 5 is a side view of an embodiment of an assembly of panels.
Figure 6:
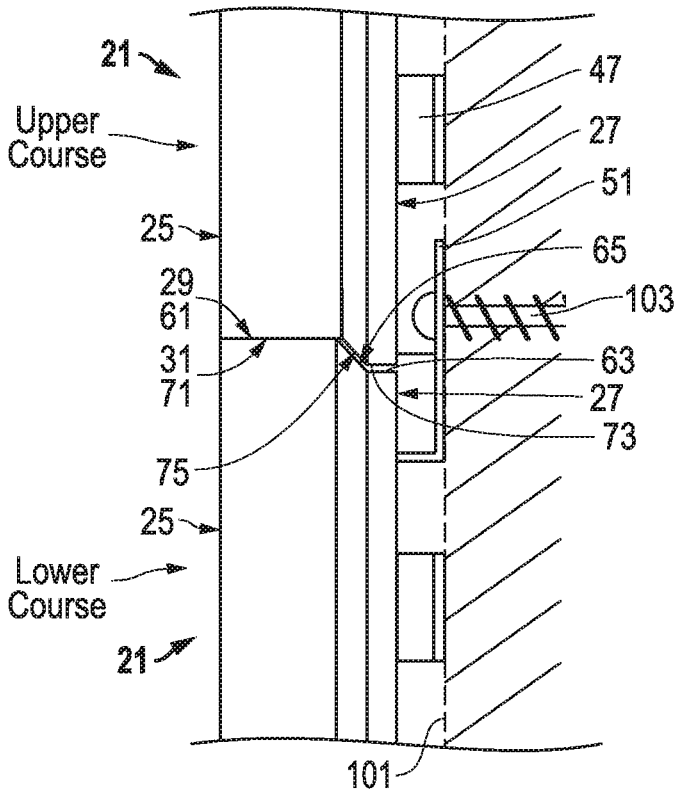
FIG. 6 is an enlarged side view of the assembly of panels of FIG. 5.

In some embodiments, the stand-offs 47 may protrude from the back 27 of the body 23, such that all of the stand-offs 47 are directly connected to each other inside the interior volume of the body 23. As shown in FIGS. 5 and 6, the stand-offs 47 may be configured to directly contact a mounting wall 101 to provide a rainscreen for the manufactured panel 21. The stand-offs 47 also may comprise an array of tabs as shown between the top 29, bottom 31 and side walls 33 of the body 23. When installed, the backs 27 of the manufactured panels 21 at the stand-offs 47 may be substantially flush with each other and substantially parallel to the mounting wall 101. Such placement of wall stand-offs better provides a more reliable and consistent rainscreen while also giving greater support for externally applied loads, thereby spreading loads from panel to wall.

In other embodiments, not every wall or substrate to which the manufactured panels 21 are mounted will be substantially or completely flat. Some walls have a surface that is irregular, any include protrusions and recesses. For such applications, the stand-offs 47 (which, in FIG. 2, comprise a total of 24 stand-offs) may be deformed or cut to accommodate the irregularities in the surface of the wall. Thus, in some embodiments, the stand-offs 47 of each manufactured panel 21 may be individually "customized" to flushly mount an array of manufactured panels 21 to an irregular wall surface (e.g., so that the panels can be substantially flush with and substantially parallel to each other and/or to a "normalized" surface of the wall). Being able to bend or cut out tabs allows the panel to 'float' wall undulations or obstructions and still maintain a rainscreen gap.

In application such as remodel work, the existing building structure wall surface may include a cord, pipe, cable or some other obstruction. Instead of having to move the such objects, embodiments of the manufactured panel can accommodate these objects by bending, cutting or completely removing any stand-offs that might otherwise obstruct them. Thus, the manufactured panels are highly adaptable and configurable for many types of applications and still permit the panels to fit and finish well.

Figure 7:
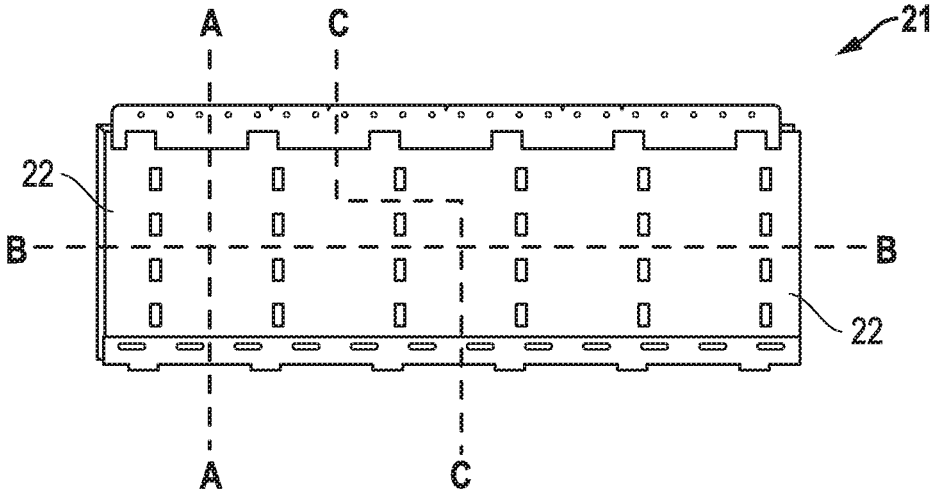
FIG. 7 is a rear view of an embodiment of a panel showing exemplary partition lines.

Referring to FIG. 7, the manufactured panel 21 may be configured to be "partitioned" (or cut as desired. For example, the panel 21 may be partitioned along vertical (e.g., see line A-A), horizontal (e.g., see line B-B) or diagonal (e.g., see line C-C) cut lines extending between adjacent ones of the tabs. Each of the partitions 22 (i.e., the separated parts 22 of the manufactured panel 21 after it is cut or partitioned) include at least one of the stand-offs 47, such that each partition 22 has at least one stand-off 47 that still functions as a rainscreen for the partition 22. Such an integrated "reinforcement" approach increases the integrity and durability of the system from impact and structure movement. The manufactured panel stays together even if cracked, impacted, etc., and it can take greater loads than conventional products.

The stand-offs 47 or array of tabs may be arranged in a substantially symmetrical pattern. Thus, in some embodiments, each of the partitions 22 include at least two or more of the stand-offs 47 that, together with a fastener hem 51, form rainscreens with at least three points of contact for the respective partitions. In some embodiments, the top portion of a panel may need to be removed to fit the last (i.e., uppermost) course on a wall. In such cases, the fastener hem may be removed, which may then require alternate methods of fastening it to the wall. Such alternate methods may include drilling a hole in the body of the panel, screwing the panel to the wall, and then covering the screw head with caulk.

Referring again to FIGS. 5 and 6, the top 29 of the body 23 may comprise an upper landing 61 that is contiguous with and substantially perpendicular to the front 25 of the body 23. The top 29 also may include a lower landing 63 contiguous and uninterrupted with the back 25, and a bevel 65 extending between the upper and lower landings 61, 63. Likewise, the bottom 31 of the body 23 may include an upper landing 71, a bevel 75 and a lower landing 73 that are complementary in shape to the upper landing 61, bevel 65 and lower landing 63, respectively, of the top 29 of the body 23.

When some embodiments of the panels 21 are mounted together, a bottom 31 of an upper manufactured panel 21 may be mounted to the top 29 of a lower manufactured panel 21. In some versions, the manufactured panels 21 may make substantially planar contact in substantially only two dimensions. For example, only the upper landings 61, 71 of the manufactured panels 21 may make contact with each other. In such instances, the bevels 65, 75 and the lower landings 63, 73 of the manufactured panels 21 have clearances such that they are respectively free of contact with each other, as shown. In some examples, each of the clearances may be in a range of about 1/16-inch to about 3/16-inch. The side walls of the panels also may be configured with a similar or identical structure.

As described herein the manufactured panel 21 may be equipped with an insert 41 having a fastener hem 51. The fastener hem 51 may be used to secure the panel 21 to a mounting wall 101 with fasteners 103 such as nails or screws. The fastener hem may be substantially flat as shown and may have no non-planar features, such as countersinks.

When the panels 21 are installed, the fastener hems 51 may be configured to be spaced apart from and free of contact with adjacent manufactured panels 21, such that no contact is made therebetween. For example, the fastener hems 51 on a lower course of panels 21 may be completely free of contact with any portions of an upper course of panels 21. The fastener hem 51 may protrude exclusively from the back 27 of the body 23, and may extend above the top 29 of the body 23, as shown. In addition, the back of fastener hem 51 and the backs of stand-offs 47 may define a co-planar surface for contacting the support wall 101.

In addition, the fastener hem 51 may further comprise apertures 53 (see, e.g., FIGS. 2 and 4) configured to provide air and moisture circulation. The apertures 53 may comprise weep holes that allow continuously connected airspace between panels 21.

Figure 8:
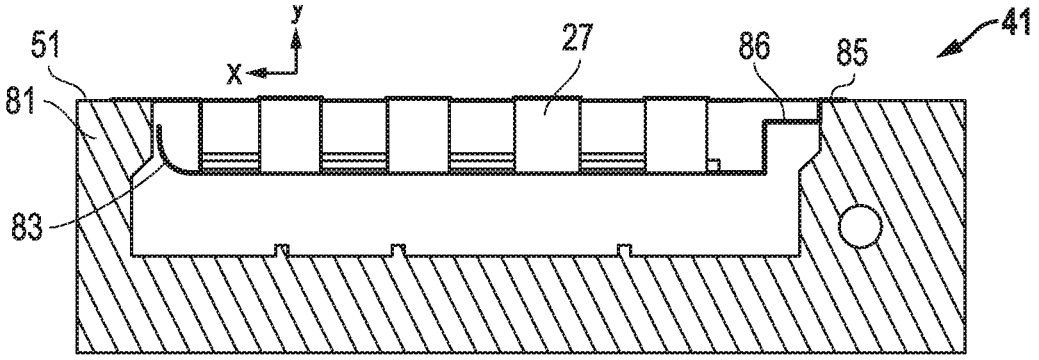
FIG. 8 is a sectional side view of an embodiment of an insert in an embodiment of a mold used to form a panel.
Figure 9:
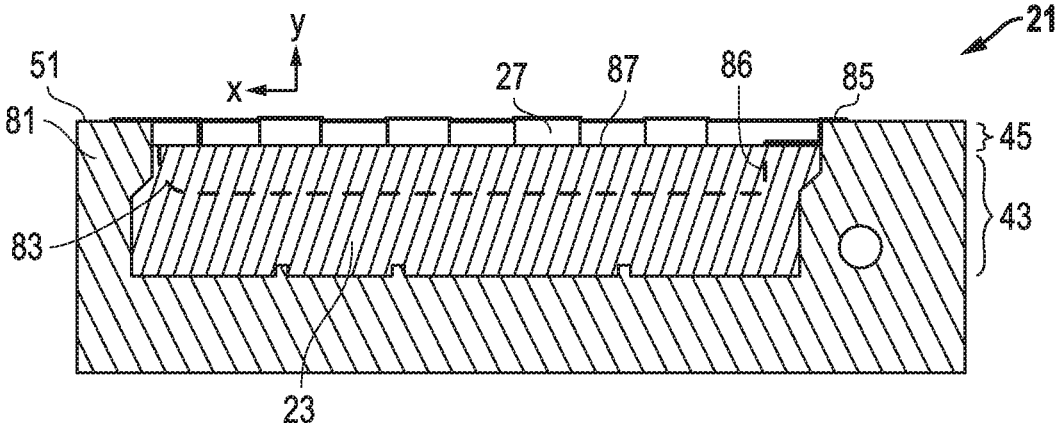
FIG. 9 is a sectional side view of an embodiment of a molded panel in an embodiment of a mold.

Referring now to FIGS. 8 and 9, the fastener hem 51 may be configured to function as a front-to-back (in the vertical or y-direction during formation) positioning stop adjacent the top 29 of the body 23 during formation of the body 23 in a mold 81. The insert 41 may further comprise curved portions 83 (FIG. 8) extending from the insert 41 adjacent the fastening hem 51. The curved portions 83 may be configured to center the insert 41 top-to-bottom (in the horizontal or x-direction) during formation of the body 23. In some embodiments, the curved portions 83 may be located entirely within the interior volume of the body 23, as shown in FIG. 9.

The insert 41 may still further comprise positioning stops 85 adjacent the bottom 31 of the body 23. The positioning stops 85 may be configured for use, for example, only during formation of the body 23. An embodiment of the positioning stops 85 may be configured to not contact any portion of an adjacent manufactured panel when installed on a building. In some versions, the positioning stops 85 do not even touch an adjacent fastener hem 51. For example, the positioning stops 85 may be configured to not engage the apertures 53 (weep holes) in the adjacent fastener hem 51. Portions 86 of the positioning stops 85 may be stepped, stair-stepped, curved, chamfered, or otherwise configured to assist in centering the insert 41 top-to-bottom (i.e., horizontally in FIGS. 8-9) during formation of the body 23 in the mold 81. The positioning stops 85 may extend to the exterior of the body 23 after formation of the body 23 (FIGS. 2 and 9). In some embodiments, the positioning stops 85 may not be used after molding and may be disregarded. Alternatively, the positioning stops 85 may be bent out of the way during installation on a building since they are not needed. For example, the positioning stops 85 may be bent for installation of the first course of panels 21 on a starter strip (not shown). And again, even if the positioning stops 85 are not bent out of the way, they will make no contact with any other panel 21 or the mounting wall 101, in some embodiments.

Thus, embodiments of the insert 41 may be configured to interact only with the mounting wall 101, such that the insert 41 may be completely free of contact with any other adjacent manufactured panel 21. This may include the insert 41 of one panel 21 having no contact with the positioning stops 85 of any other adjacent manufactured panel 21. In some embodiments, only the fastener hem 51 and stand-offs 47 may be configured to touch the mounting wall 101.

Embodiments of the manufactured panel 21 may be configured to be secured to the mounting wall 101 only with fasteners through the fastener hem 51. Examples include no other separate mounting brackets being required to secure the manufactured panel 21 to the mounting wall 101.

Figure 10:
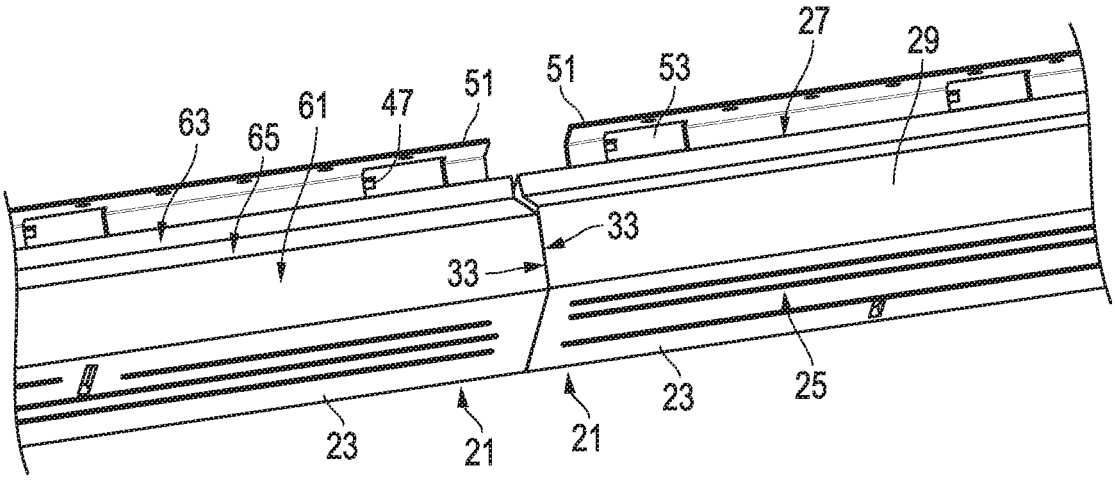
FIG. 10 is a top view of an embodiment of an assembly of panels.

As shown in FIG. 10, the side walls 33 may further comprise beveled, upper and lower landing surfaces that are configured to engage laterally adjacent ones of manufactured panels upon installation. The side walls 33 may be provided with similar shapes, two-dimensional contact and clearances as described herein for the tops 29 and bottoms 31 of panels 21.

Figure 11:
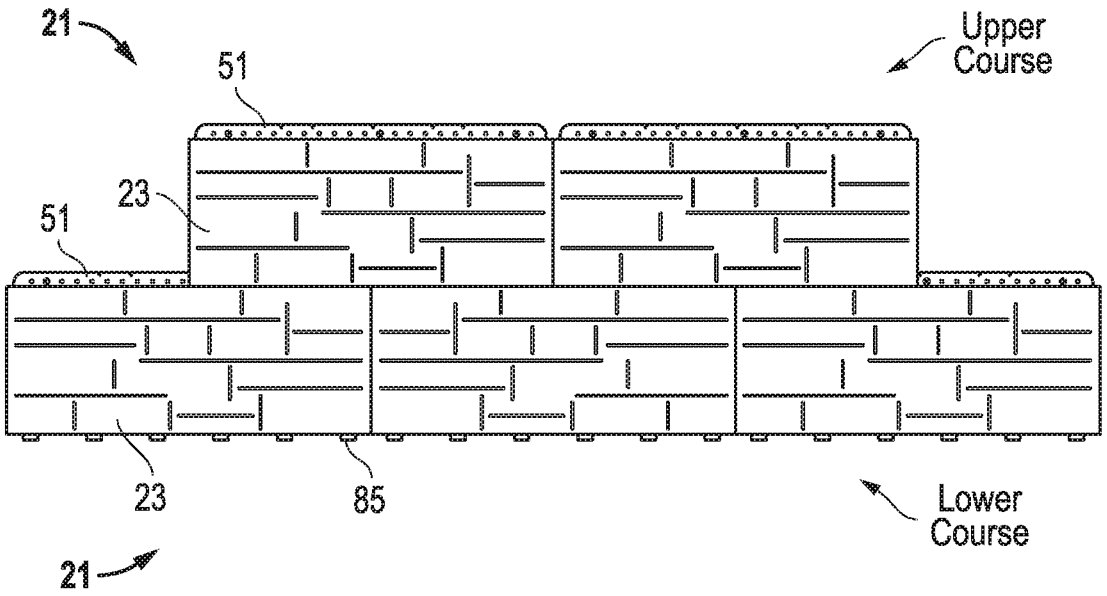
FIGS. 11 and 12 are front and rear views, respectively, of an embodiment of an assembly of panels.
Figure 12:
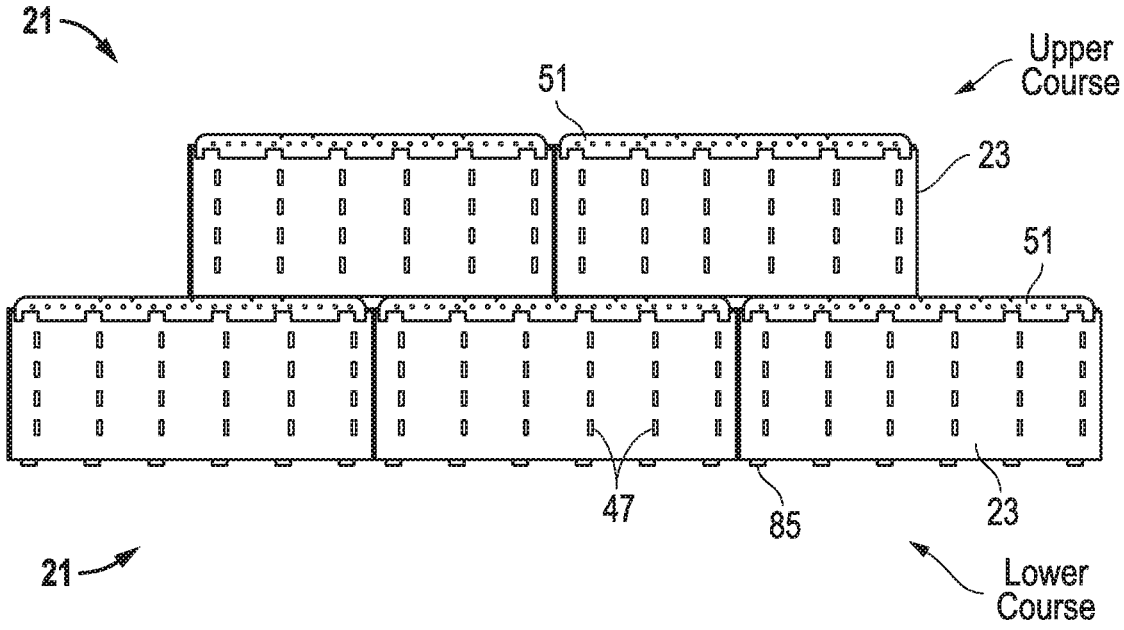

Embodiments of a system of panels 21 may comprise a plurality of panels 21 (e.g., FIGS. 11 and 12), such as the first and second manufactured panels shown in FIGS. 5 and 6. Each panel 21 may comprise body 23 having front 25, back 27, top 29, bottom 31 and side walls 33. Both the top 25 and bottom 31 of the body 23 may comprise an upper landing 61, 71, respectively, that is contiguous with and substantially perpendicular to the front 25 of the body 23. A lower landing 63, 73 is contiguous and uninterrupted with the back 27, and a bevel 65, 75 extends between the upper and lower landings 61, 71 and 63, 73, respectively, such that the top 29 and bottom 31 are complementary in shape to each other. An insert 41 may be located inside the body 23 and extending from the body 23. These embodiments also may be configured as described elsewhere herein.

Still other embodiments may comprise a method of installing panels 21 to form a building façade. The method may comprise providing a plurality of manufactured panels 21. Each panel 21 may have various components as described elsewhere herein. The method may comprise installing the fastener hems 51 of a first course of manufactured panels 21 on a mounting wall 101. FIGS. 5 and 6. One or more of the panels 21 may be partitioned as described elsewhere herein. FIG. 7. The method also may comprise installing a second course of manufactured panels 21 on the mounting wall 101 on top of the first course of manufactured panels 21, such that the first and second courses of manufactured panels 21 make substantially planar contact in substantially only two dimensions at the tops 29 of the first course of manufactured panels 21 and the bottoms 31 of the second course of manufactured panels 21. Again, these embodiments also may be configured, partitioned and installed as described elsewhere herein.

Again referring to FIGS. 8 and 9, embodiments of a method of fabricating panels 21 may comprise providing an insert 41 having an interior portion 43 with curved portions 83, and a positioning stop 85 opposite the curved portions 83, and an exterior portion 45 including a fastener hem 51.

The method may comprise placing the insert 41 in a mold 81 such that only the fastener hem 51 and the positioning stop 85 contact the mold 81. The method may further comprise centering the insert 41 in the mold 81 with the curved portions 83 and the positioning stop 85. Next, the method may comprise filling the mold 81 with a liquid 87 (i.e., the material used to form the body 23) such that the interior portion 43 is submerged in the liquid 87 including the curved portions 83, but some of the positioning stop 85 is not submerged in the liquid 87. Subsequent steps may comprise curing the liquid 87 to form a panel 21 (e.g., body 23) on the insert 41, and removing the panel 21 from the mold 81.

Embodiments of the curved portions 83 and the positioning stop 85 may comprise portions that may be used to center the insert 41 in the mold 81. The portions may be located entirely within an interior volume of the panel 21. As described herein, the positioning stops 85 may extend to the exterior of the body 23 after formation of the body 23. It is permissible, in some embodiments, for the positioning stops 85 to not be used thereafter such that they may be disregarded. However, the positioning stops 85 may be bent out of the way during installation since they are not needed. For example, the positioning stops 85 may be bent for installation of the first course of panels 21 on a starter strip. And again, even if they are not bent out of the way, the positioning stops 85 will make no contact with any other panel 21 or the mounting wall 101, in some embodiments.

Other embodiments may include the following.

Item 1. A manufactured panel, comprising: a body having a front, back, top, bottom and side walls, the side walls extend between the front and back, and an interior volume located between the front, back, top, bottom and side walls; and an insert having an interior portion embedded within the interior volume of the body, and an exterior portion extending from the interior portion to an exterior of the body, the exterior portion comprises a plurality of stand-offs protruding from the body, such that at least some of the stand-offs are connected to each other inside the interior volume of the body, and at least some of the stand-offs are independent and detached from each other on the exterior of the body.

Item 2. The manufactured panel of Item 1, wherein the body comprises an exterior building façade or an interior building façade.

Item 3. The manufactured panel of Item 1, wherein the plurality of stand-offs protrude from the back of the body, such that all of the stand-offs are directly connected to each other inside the interior volume of the body.

Item 4. The manufactured panel of Item 1, wherein the stand-offs are configured to directly contact a mounting wall to provide a rainscreen for the manufactured panel.

Item 5. The manufactured panel of Item 1, wherein the stand-offs comprise an array of tabs between the top, bottom and side walls of the body, such that the manufactured panel is configured to be partitioned along vertical, horizontal or diagonal cut lines extending between adjacent ones of the tabs, and each of the partitions include at least one of the stand-offs such that the at least one of the stand-offs still functions as a rainscreen for the partition.

Item 6. The manufactured panel of Item 5, wherein the array of tabs are in a substantially symmetrical pattern, and each of the partitions include at least two or more of the stand-offs that, together with a fastener hem, form rainscreens with at least three points of contact for the respective partitions.

Item 7. The manufactured panel of Item 1, wherein the interior portion of the insert extends substantially throughout the body between the top, bottom and side walls of the body.

Item 8. The manufactured panel of Item 1, wherein the interior portion is substantially planar and forms a continuous reinforcement throughout the body.

Item 9. The manufactured panel of Item 1, wherein the top of the body comprises an upper landing that is contiguous with and substantially perpendicular to the front of the body, a lower landing contiguous and uninterrupted with the back, and a bevel extending between the upper and lower landings.

Item 10. The manufactured panel of Item 9, wherein the bottom of the body includes an upper landing, a bevel and a lower landing that are complementary in shape to the upper landing, bevel and lower landing, respectively, of the top of the body.

Item 11. The manufactured panel of Item 1, further comprising a second manufactured panel configured substantially identical to said manufactured panel, a bottom of the second manufactured panel is mounted to the top of said manufactured panel, and the manufactured panels make substantially planar contact in substantially only two dimensions.

Item 12. The manufactured panel of Item 11, wherein the top of each body comprises an upper landing that is contiguous with and substantially perpendicular to the front of the body, a lower landing contiguous and uninterrupted with the back, a bevel extending between the upper and lower landings, the bottom of each body includes an upper landing, a bevel and a lower landing that are complementary in shape to the upper landing, bevel and lower landing, respectively, of the top of the body, and only the upper landings of the manufactured panels make contact with each other, and the bevels and the lower landings of the manufactured panels have clearances such that they are respectively free of contact with each other.

Item 13. The manufactured panel of Item 12, wherein each of the clearances is in a range of about 1/16-inch to about 3/16-inch.

Item 14. The manufactured panel of Item 11, wherein the backs of the manufactured panels at the stand-offs are substantially flush with each other.

Item 15. The manufactured panel of Item 1, wherein the insert of the manufactured panel further comprises a fastener hem.

Item 16. The manufactured panel of Item 15, wherein the fastener hem is substantially flat and has no non-planar features.

Item 17. The manufactured panel of Item 15, wherein the fastener hem of the manufactured panel is configured to be spaced apart from and free of contact with a bottom of a second adjacent manufactured panel, such that no contact is made therebetween.

Item 18. The manufactured panel of Item 15, wherein the fastener hem protrudes exclusively from the back of the body and extends above the top of the body.

Item 19. The manufactured panel of Item 15, wherein the fastener hem further comprises apertures configured to provide air and moisture circulation.

Item 20. The manufactured panel of Item 15, wherein the fastener hem is configured to function as a positioning stop adjacent the top of the body during formation of the body.

Item 21. The manufactured panel of Item 15, further comprising curved portions extending from the insert adjacent the fastening hem, wherein the curved portions are configured to center the insert top-to-bottom during formation of the body.

Item 22. The manufactured panel of Item 21, wherein the curved portions are located entirely within the interior volume of the body.

Item 23. The manufactured panel of Item 1, wherein the insert further comprises positioning stops adjacent the bottom of the body, the positioning stops are configured for use only during formation of the body, and the positioning stops are configured to not contact any portion of an adjacent manufactured panel when installed.

Item 24. The manufactured panel of Item 23, wherein portions of the positioning stops are stepped and configured to center the insert top-to-bottom during formation of the body.

Item 25. The manufactured panel of Item 16, wherein the insert is configured to interact only with a mounting wall and the insert is completely free of contact with any other adjacent manufactured panel.

Item 26. The manufactured panel of Item 17, wherein the manufactured panel is configured to be secured to the mounting wall only with fasteners through the fastener hem, and no other separate mounting brackets are required to secure the manufactured panel to the mounting wall.

Item 27. The manufactured panel of Item 1, wherein the side walls further comprise beveled surfaces configured to engage laterally adjacent ones of manufactured panels upon installation.

Item 28. The manufactured panel of Item 1, wherein a back of a fastener hem and backs of the stand-offs define a co-planar surface for contacting a support wall.

Item 29. A system of panels, comprising: first and second manufactured panels, each comprising: a body having a front, back, top, bottom and side walls, the side walls extend between the front and back, and an interior volume located between the front, back, top, bottom and side walls; wherein both the top and the bottom of the body comprise an upper landing that is contiguous with and substantially perpendicular to the front of the body, a lower landing contiguous and uninterrupted with the back, and a bevel extending between the upper and lower landings, such that the top and bottom are complementary in shape to each other; and an insert located inside the body and extending from the body.

Item 30. The system of Item 29, wherein the second manufactured panel is mounted to the first manufactured panel, such that the manufactured panels make substantially planar contact in substantially only two dimensions at the upper landing at the top of the first manufactured panel and the upper landing at the bottom of the second manufactured panel.

Item 31. The system of Item 29, wherein the bodies comprise an exterior or interior building façade.

Item 32. The system of Item 29, wherein each of the inserts has an interior portion completely embedded within the interior volume of the body, and an exterior portion extending from the interior portion to an exterior of the body, the exterior portion comprises a plurality of stand-offs protruding from the body, such that at least some of the stand-offs are connected to each other inside the interior volume of the body, and the stand-offs are independent and detached from each other on the exterior of the body.

Item 33. The system of Item 32, wherein the plurality of stand-offs protrude from the back of the body, such that all of the stand-offs are directly connected to each other inside the interior volume of the body.

Item 34. The system of Item 32, wherein the stand-offs are configured to directly contact a mounting wall to provide a rainscreen for the manufactured panel.

Item 35. The system of Item 32, wherein the stand-offs comprise an array of tabs between the top, bottom and side walls of the body, such that the manufactured panel is configured to be partitioned along vertical, horizontal or diagonal cut lines extending between adjacent ones of the tabs, and each of the partitions include at least one of the stand-offs such that the at least one of the stand-offs still functions as a rainscreen for the partition.

Item 36. The system of Item 35, wherein the array of tabs are in a substantially symmetrical pattern, and each of the partitions include at least two or more of the stand-offs that, together with a fastener hem, form rainscreens with at least three points of contact for the respective partitions.

Item 37. The system of Item 32, wherein the interior portion of the insert extends substantially throughout the body between the top, bottom and side walls of the body.

Item 38. The system of Item 32, wherein the interior portion is substantially planar and forms a continuous reinforcement throughout the body.

Item 39. The system of Item 29, wherein the bevels and the lower landings of the manufactured panels have clearances such that they are respectively free of contact with each other.

Item 40. The system of Item 39, wherein each of the clearances is in a range of about 1/16-inch to about 3/16-inch.

Item 41. The system of Item 29, wherein the backs of the manufactured panels are substantially flush with each other.

Item 42. The system of Item 29, wherein each of the inserts of the manufactured panels further comprise a fastener hem.

Item 43. The system of Item 42, wherein the fastener hem is substantially flat and has no non-planar features.

Item 44. The system of Item 42, wherein the fastener hems of the first manufactured panel is spaced apart from and free of contact with the bottom of the second manufactured panel, such that no contact is made therebetween.

Item 45. The system of Item 42, wherein the fastener hems protrude exclusively from the backs of the respective bodies and extend above the tops of the respective bodies.

Item 46. The system of Item 42, wherein each of the fastener hems further comprise apertures that provide air and moisture circulation between the manufactured panels and a mounting wall.

Item 47. The system of Item 42, wherein the fastener hems are configured to function as positioning stops adjacent the tops of the respective bodies during formation of the bodies.

Item 48. The system of Item 47, further comprising curved portions extending from the inserts adjacent the respective fastening hems, wherein the curved portions are configured to center the inserts top-to-bottom during formation of the bodies.

Item 49. The system of Item 48, wherein the curved portions are located entirely within the interior volume of the respective bodies.

Item 50. The system of Item 29, wherein each of the inserts further comprises positioning stops adjacent the bottom of the body, the positioning stops are configured for use only during formation of the body, and the positioning stops are configured to not contact any portion of an adjacent manufactured panel when installed.

Item 51. The system of Item 50, wherein portions of the positioning stops are stepped and configured to center the insert top-to-bottom during formation of the body.

Item 52. The system of Item 29, wherein the inserts interact only with a mounting wall and the inserts are completely free of contact with any other adjacent manufactured panel.

Item 53. The system of Item 29, wherein the manufactured panels are secured to a mounting wall only with fasteners through fastener hems, and no other separate mounting brackets are required to secure the manufactured panels to the mounting wall.

Item 54. The system of Item 29, wherein the side walls further comprise beveled surfaces to engage laterally adjacent ones of manufactured panels upon installation.

Item 55. A method of installing panels to form a building façade, comprising: providing a plurality of manufactured panels, each having a body with a front, back, top, bottom and side walls, the side walls extend between the front and back, an interior volume located between the front, back, top, bottom and side walls, and an insert located inside the body and extending from the body as a fastener hem; installing the fastener hems of a first course of manufactured panels on a mounting wall; and installing a second course of manufactured panels on the mounting wall on top of the first course of manufactured panels, such that the first and second courses of manufactured panels make substantially planar contact in substantially only two dimensions at the tops of the first course of manufactured panels and the bottoms of the second course of manufactured panels.

Item 56. The method of Item 55, wherein both the tops and the bottoms of each of the bodies comprise an upper landing that is contiguous with and substantially perpendicular to the front of the body, a lower landing contiguous and uninterrupted with the back, and a bevel extending between the upper and lower landings, such that the top and bottom are complementary in shape to each other.

Item 57. The method of Item 55, wherein the bevels and the lower landings of the manufactured panels have clearances such that they are respectively free of contact with each other.

Item 58. The method of Item 57, wherein each of the clearances is in a range of about 1/16-inch to about 3/16-inch.

Item 59. The method of Item 55, wherein the backs of the manufactured panels are substantially flush with each other.

Item 60. The method of Item 55, wherein the fastener hems are substantially flat and have no non-planar features.

Item 61. The method of Item 55, wherein the fastener hems of the first course of manufactured panels are spaced apart from and free of contact with the bottoms of the second course of manufactured panels, such that no contact is made therebetween.

Item 62. The method of Item 55, wherein the fastener hems protrude exclusively from the backs of the respective bodies and extend above the tops of the respective bodies.

Item 63. The method of Item 55, wherein each of the fastener hems further comprise apertures that provide air and moisture circulation between the manufactured panels and the mounting wall.

Item 64. The method of Item 55, wherein the inserts interact only with the mounting wall and the inserts are completely free of contact with any other adjacent manufactured panel.

Item 65. The method of Item 55, wherein the manufactured panels are secured to the mounting wall only with fasteners through fastener hems, and no other separate mounting brackets are required to secure the manufactured panels to the mounting wall.

Item 66. The method of Item 55, wherein the side walls further comprise beveled surfaces to engage laterally adjacent ones of the manufactured panels in each course.

Item 67. The method of Item 55, wherein each of the inserts has an interior portion completely embedded within the interior volume of the body, and an exterior portion extending from the interior portion to an exterior of the body, the exterior portion comprises a plurality of stand-offs protruding from the body, such that at least some of the stand-offs are connected to each other inside the interior volume of the body, and the stand-offs are independent and detached from each other on the exterior of the body.

Item 68. The method of Item 67, wherein the plurality of stand-offs protrude from the back of the body, such that all of the stand-offs are directly connected to each other inside the interior volume of the body.

Item 69. The method of Item 67, wherein the stand-offs directly contact the mounting wall to provide a rainscreen for the manufactured panels.

Item 70. The method of Item 67, wherein the stand-offs comprise an array of tabs between the top, bottom and side walls of the body, and further comprising partitioning at least some of the manufactured panels along vertical, horizontal or diagonal cut lines extending between adjacent ones of the tabs, and installing the partitions on the mounting wall such that at least one of the stand-offs still functions as a rainscreen for each of the respective partitions relative to the mounting wall.

Item 71. The method of Item 70, wherein the array of tabs are in a substantially symmetrical pattern, and each of the partitions includes at least two or more of the stand-offs that, together with a fastener hem, form rainscreens with at least three points of contact for the respective partitions.

Item 72. The method of Item 67, wherein the interior portion of the insert extends substantially throughout the body between the top, bottom and side walls of the body.

Item 73. The method of Item 67, wherein the interior portion is substantially planar and forms a continuous reinforcement throughout the body.

Item 74. The method of Item 67, wherein a back of the fastener hem and backs of the stand-offs define a co-planar surface for contacting the support wall.

Item 75. A method of fabricating panels, comprising: providing an insert having an interior portion with a top portion and a positioning stop opposite the top portion, and an exterior portion including a fastener hem; placing the insert in a mold such that only the fastener hem and the positioning stop contact the mold; centering the insert in the mold with the top portion and the positioning stop; filling the mold with a casting material such that the interior portion is submerged in the casting material including the top portion, but some of the positioning stop is not submerged in the casting material; curing the casting material to form a panel on the insert; and removing the panel form the mold.

Item 76. The method of Item 75, wherein the top portion and the positioning stop center the insert in the mold.

Item 77. The method of Item 76, wherein the top portion is located entirely within an interior volume of the panel.

Item 78. The method of Item 75, wherein the panel comprises an exterior or interior building façade.

Item 79. The method of Item 75, wherein the exterior portion comprises a plurality of stand-offs protruding from the panel, such that at least some of the stand-offs are connected to each other inside an interior volume of the panel, and the stand-offs are independent and detached from each other on an exterior of the body.

Item 80. The method of Item 79, wherein the plurality of stand-offs protrude from a back of the panel, such that all of the stand-offs are directly connected to each other inside the interior volume of the panel.

Item 81. The method of Item 79, further comprising partitioning the panel, wherein the stand-offs comprise an array of tabs, such that the panel is configured to be partitioned along vertical, horizontal or diagonal cut lines extending between adjacent ones of the tabs, and each of the partitions include at least one of the stand-offs such that the at least one of the stand-offs is configured to function as a rainscreen for the partition.

Item 82. The method of Item 81, wherein the array of tabs are in a substantially symmetrical pattern, and each of the partitions includes at least two or more of the stand-offs that, together with the fastener hem, form rainscreens with at least three points of contact for the respective partitions.

Item 83. The method of Item 75, wherein the interior portion of the insert extends substantially throughout the panel.

Item 84. The method of Item 75, wherein the interior portion is substantially planar and forms a continuous reinforcement throughout the panel.

Item 85. The method of Item 75, wherein the fastener hem is substantially flat and has no non-planar features.

Item 86. The method of Item 75, wherein the fastener hem protrudes exclusively from a back of the panel and extends above a top of the panel.

Item 87. The method of Item 75, wherein the fastener hem further comprises apertures configured to provide air and moisture circulation.

Item 88. The method of Item 75, wherein the casting material comprises a liquid, a powder, pellets or a combination thereof.

Item 89. The manufactured panel of Item 1, wherein the plurality of stand-offs are configured to be independently deformed or cut to accommodate irregularities in a surface of a mounting wall to which the manufactured panel is to be mounted, such that the plurality of stand-offs are customizable to flushly mount the manufactured panel to the irregular mounting wall surface.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A panel, comprising:

a body; and an insert having an interior portion embedded within the body, at least one standoff extending from the interior portion and protruding from a back of the body, and an exterior portion extending from the body and comprising a fastener hem and at least one positioning stop coupled to the interior portion, wherein a back of the at least one standoff and a back of the fastener hem are substantially coplanar.

2. The panel of claim 1, wherein the interior portion is substantially planar.

3. The panel of claim 2, wherein the interior portion forms a continuous reinforcement throughout the body.

4. The panel of claim 1, wherein the insert comprises portions extending from the interior portion adjacent to the fastening hem.

5. The panel of claim 4, wherein the portions are configured to center the insert from top-to-bottom in a mold during formation of the body.

6. The panel of claim 5, wherein the portions are embedded within the body.

7. The panel of claim 1, wherein the fastener hem is disposed at a top of the insert.

8. The panel of claim 7, wherein the fastener hem is configured to center the insert from front-to-back in a mold during formation of the body.

9. The panel of claim 1, wherein the at least one positioning stop is disposed at a bottom of the insert.

10. The panel of claim 9, wherein the at least one positioning stop is stepped, stair-stepped, curved, chamfered, or otherwise configured to center the insert from top-to-bottom in a mold during formation of the body.

11. A panel, comprising:

a body; and an insert having an interior portion embedded within the body, a plurality of standoffs extending from the interior portion and protruding from a back of the body, and an exterior portion extending from the body and comprising a fastener hem coupled to the interior portion, wherein the fastener hem comprises a plurality of apertures, and wherein the fastener hem and the plurality of standoffs are substantially coplanar and configured to directly contact a mounting wall to provide a rainscreen for the panel.

12. The panel of claim 11, wherein the insert is formed from a non-corrosive material.

13. The panel of claim 12, wherein the non-corrosive material comprises galvanized steel or stainless steel.

14. The panel of claim 11, wherein the fastener hem is disposed at a top of the insert.

15. The panel of claim 14, wherein at least one positioning stop is disposed at a bottom of the insert.

16. The panel of claim 11, wherein the plurality of standoffs are connected inside the interior volume of the body to the interior portion.

17. The panel of claim 11, wherein the apertures comprise weep holes that provide continuously connected airspace between adjacent panels.

18. The panel of claim 17, wherein the plurality of apertures are configured to provide air and moisture circulation between adjacent panels.

* * * * *